US011145278B2

(12) United States Patent
Takata et al.

(10) Patent No.: US 11,145,278 B2
(45) Date of Patent: Oct. 12, 2021

(54) KEYBOARD INSTRUMENT

(71) Applicant: Roland Corporation, Shizuoka (JP)

(72) Inventors: Yukihide Takata, Shizuoka (JP); Yoshiyasu Kitagawa, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 16/274,251

(22) Filed: Feb. 13, 2019

(65) Prior Publication Data

US 2019/0259356 A1 Aug. 22, 2019

(30) Foreign Application Priority Data

Feb. 16, 2018 (JP) ..... JP2018-026259

(51) Int. Cl.
*G10C 3/12* (2006.01)
*B44F 9/00* (2006.01)
*G10H 1/34* (2006.01)

(52) U.S. Cl.
CPC ..... *G10C 3/125* (2013.01); *B44F 9/00* (2013.01); *G10H 1/346* (2013.01)

(58) Field of Classification Search
CPC ..... G10C 3/125; G10H 1/346; G10H 1/344; B44F 9/00
See application file for complete search history.

(56) References Cited

U.S. PATENT DOCUMENTS 4,914,999 A * 4/1990 Masubuchi ..... G10C 3/12 200/5 A
5,847,301 A 12/1998 Steinbuhler
6,118,063 A 9/2000 Steinbuhler
7,952,010 B2 * 5/2011 Minakawa ..... G10C 3/125 84/423 R
8,841,532 B2 9/2014 Shir
9,064,478 B1 6/2015 Shir
9,633,630 B2 4/2017 Ceccarini
2016/0071498 A1 * 3/2016 Hoshino ..... G10C 3/04 84/433
2016/0155430 A1 6/2016 Ceccarini
2016/0217702 A1 * 7/2016 Caldwell-Edmonds ..... G10G 1/02

FOREIGN PATENT DOCUMENTS

| | | |
|---|---|---|
| CN | 2337642 | 9/1999 |
| JP | 2009042381 | 2/2009 |
| JP | 2009169361 | 7/2009 |
| JP | 2012083437 | 4/2012 |
| JP | 2012113144 | 6/2012 |

OTHER PUBLICATIONS https://en.wikipedia.org/wiki/Musical_keyboard#:~:text=Modern%20piano%20keyboards%20ordinarily%20have%20an%20octave%20span,wide%20at%20the%20base%2C%20disregarding%20space%20between%20keys Aug. 10, 1998.*
"Office Action of Japan Counterpart Application", dated Aug. 3, 2021, with English translation thereof, p. 1-p. 8.

* cited by examiner

*Primary Examiner* — Kimberly R Lockett
(74) *Attorney, Agent, or Firm* — JCIPRNET

(57) ABSTRACT

There is provided a keyboard instrument in which a plurality of white keys and a plurality of black keys are arranged in a widthwise direction, a total width dimension of the plurality of white keys that constitute one octave is set to 160 mm or less, and a width dimension of an upper surface of each of the black keys is set to 9 mm or more and 10.5 mm or less.

20 Claims, 2 Drawing Sheets

KEYBOARD INSTRUMENT

CROSS-REFERENCE TO RELATED APPLICATION

This application claims the priority benefit of Japan Application No. 2018-026259, filed on Feb. 16, 2018. The entirety of the above-mentioned patent application is hereby incorporated by reference herein and made a part of this specification.

BACKGROUND

Technical Field

The disclosure relates to a keyboard instrument, and more particularly, to a keyboard instrument capable of improving operability upon musical performance.

Description of Related Art

A technology of forming a shape of each of black keys for a keyboard instrument in a shape different from a standard form and improving operability of the white keys or black keys during musical performance is known. For example, Patent Document 1 (U.S. Patent Application Publication No. US20160155430A1 (for example, Paragraphs 0028-0030, 0045 and 0049, FIGS. 3 to 8)) discloses a keyboard instrument including a configuration in which a width dimension of each of bottom surfaces of black keys corresponding to pitch names of F #, G # and A # is set to be smaller than that of other black keys or a configuration in which an inclined angle or a surface shape of side surfaces facing each other between the black keys is varied. According to the keyboard instrument, when the white keys disposed between the black keys (corresponding to pitch names of D, G and A) are operated by a musical performer, since it is possible to minimize interference of the black keys with a musical performer's fingers, operability during musical performance can be improved.

However, in the related art, when a total width dimension of the keys of a keyboard instrument is smaller than that of a standard keyboard instrument, it is not considered what type of black key is preferable. That is, for example, when the total width dimension of the keys of the keyboard instrument is smaller than that of a standard keyboard instrument, in the related art, a configuration in which a width dimension of every black key (white key) is reduced has been employed. Further, in the related art, a configuration in which a width dimension of every black key (white key) is reduced by the same proportion has also been employed. Accordingly, a width dimension of the black keys may be reduced and operability during musical performance may be decreased.

SUMMARY

One of the embodiments of the disclosure provides a keyboard instrument and includes a plurality of white keys and a plurality of black keys, which are arranged in a widthwise direction, wherein a total width dimension of the plurality of white keys that constitute one octave is set to 160 mm or less, and a width dimension of an upper surface of each of the black keys is set to 9 mm or more and 10.5 mm or less.

DESCRIPTION OF THE EMBODIMENTS

One of the embodiments of the disclosure provides a keyboard instrument capable of improving operability during musical performance.

Figure 1:
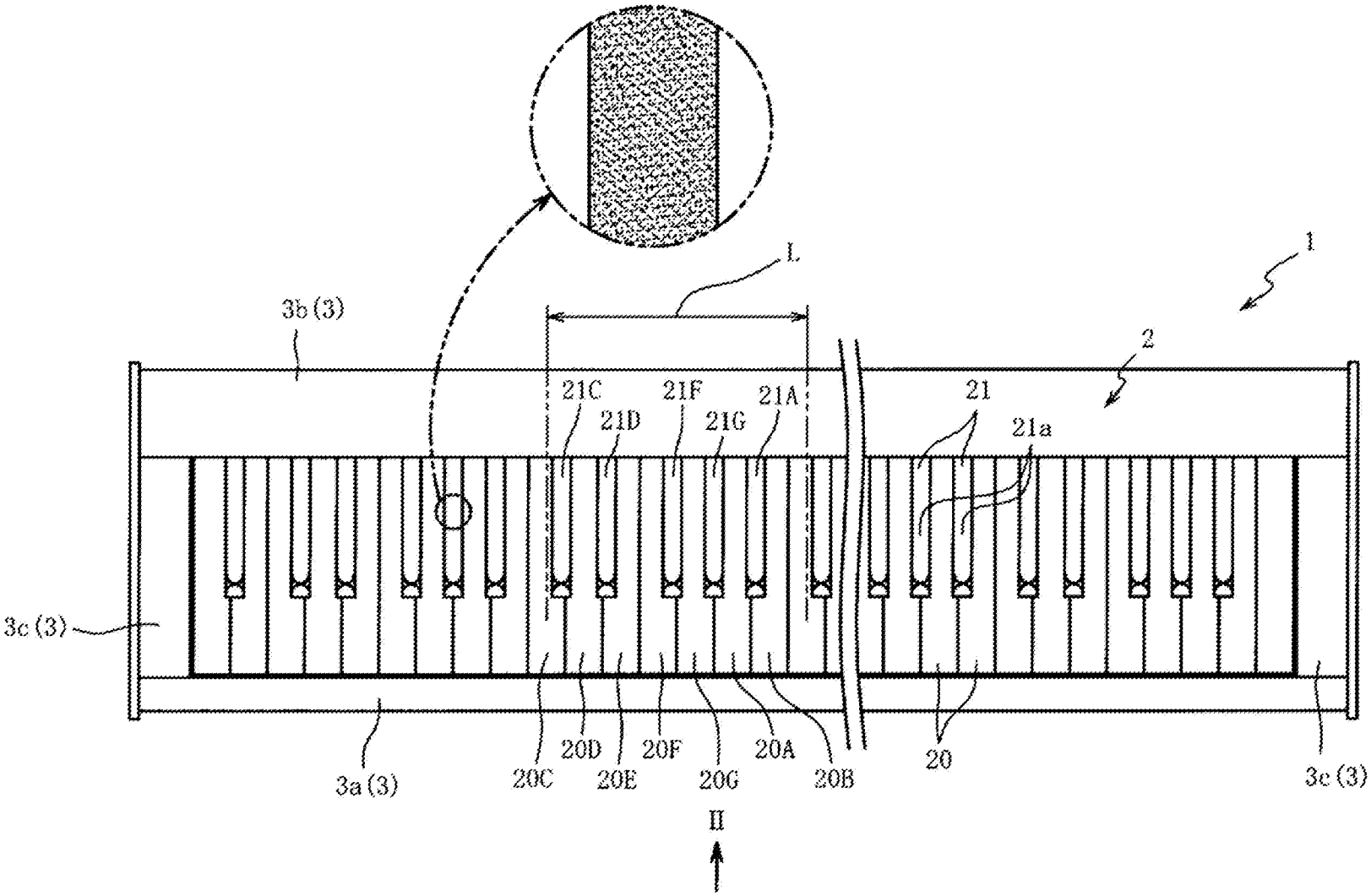
FIG. 1 is a plan view of a keyboard instrument according to an embodiment.

Hereinafter, a preferable embodiment will be described with reference to the accompanying drawings. First, a configuration of a keyboard instrument 1 will be described with reference to FIG. 1. FIG. 1 is a plan view of the keyboard instrument 1 according to the embodiment. Further, in FIG. 1, in order to simplify the drawings, illustration of a configuration such as side surfaces 21*b* (see FIG. 2) or the like of black keys 21 is partially omitted and schematically illustrated.

As shown in FIG. 1, the keyboard instrument 1 is configured as an electronic musical instrument (an electronic piano) including a plurality of (in the embodiment, 88) keys 2, and a panel 3 that surrounds the plurality of keys 2. The keys 2 are constituted by a plurality of (in the embodiment, 52) white keys 20 configured to play natural tones and a plurality of (in the embodiment, 36) black keys 21 configured to play derived tones, and the plurality of white keys 20 and black keys 21 are arranged in a widthwise direction (a leftward/rightward direction in FIG. 1).

The white keys 20 are formed of a resin material in a shape in which a width dimension of each part of a white key of a standard keyboard instrument is reduced to a predetermined proportion (in the embodiment, about 15/16). Further, the standard keyboard instrument is a standard keyboard instrument pursuant to JIS 58507 (1992 edition), and in the following description, simplified and described as "a standard keyboard instrument."

The black keys 21 extend in the forward/rearward direction, and a relative position of the black keys 21 with respect to the white keys 20 (a positional relation between a center of the white keys 20 in a widthwise direction and a center of the black keys 21 in the widthwise direction) is set to be the same as in the standard keyboard instrument.

Further, in the following description, when the white keys 20 are individually identified according to pitch names (C, D, E, F, G, A and B), the white keys 20 will be described by being denoted by corresponding pitch names (for example, the white key 20 corresponding to a pitch name of C will be described as "the white key 20C"). In addition, when the black keys 21 are also individually identified according to pitch names (C #, D #, F #, G # and A #), the black keys 21 will be described by being denoted by corresponding pitch names (for example, the black key 21 corresponding to a pitch name of C # will be described as "the black key 21C").

The panel 3 includes a front panel 3*a*, a rear panel 3*b* disposed to face the front panel 3*a* in the forward/rearward direction (an upward/downward direction in FIG. 1), and a pair of end panels 3*c* configured to connect end portions of the front panel 3*a* and the rear panel 3*b* in a widthwise direction, and the white keys 20 and the black keys 21 are surrounded by the front panel 3*a*, the rear panel 3*b*, and the pair of end panels 3*c*. The symbol 3*a* (3) in FIG. 1 means the front panel 3*a* of the panel 3, the other symbols marked as the same way are the same meanings.

For example, a display device constituted by an LED, a liquid crystal display, or the like, and configured to display various states, and a plurality of operators configured to allow volume adjustment, mode change, or the like, to be performed are disposed on an upper surface (a surface in front in the drawing of FIG. 1) of the rear panel 3*b* (neither is shown). In addition, for example, a power switch, and a plurality of jacks configured to input and output a MIDI signal, or an audio signal are disposed on a back surface of the rear panel 3*b* (neither is shown).

The white keys 20 and the black keys 21 are configured to be pivoted at areas on base end sides (the rear panel 3*b* side) and swingable around axes thereof (vertically). Each of the white keys 20 and the black keys 21 is formed in a box shape having an opening on a lower surface thereof, and vertical swinging of each of the white keys 20 and the black keys 21 is guided by a guide post (not shown) since the guide post is inserted through the opening portion.

In addition, while not shown, the keyboard instrument 1 includes hammers linked (pivoted) according to operations on the white keys 20 and the black keys 21 by a musical performer's operations (key pressing or key releasing), and switches configured to be turned on/off according to pivoting movement of the hammers (or the white keys 20 and the black keys 21). When the white keys 20 or the black keys 21 are pressed by a musical performer, since the hammers pivot against their own weights, an operation feeling that approximates to an acoustic piano can be provided.

In addition, the switches are turned on/off when the hammers (or, the white keys 20 and the black keys 21) are pivoted. Key pressing information (velocities) of the white keys 20 and the black keys 21 is detected by on/off operations of the switches, and musical sound signals are output to the outside on the basis of the detection results.

Here, a total width dimension of the keys of the standard keyboard instrument is 1220 mm to 1230 mm. Accordingly, a total width dimension of the white keys that constitute one octave in the standard keyboard instrument is about 164.2 to 165.6 mm, and it may be impossible for a musical performer having relatively small hands (for example, children) to simultaneously press one white key and a white key one octave above (below) this one white key with one hand only.

On the other hand, in the embodiment, a width dimension L from a center of one white key 20 (for example, the white key 20C) in the widthwise direction to a center of the white key 20 (for example, the white key 20C) one octave above (below) this one white key 20 in the widthwise direction (i.e., a total width dimension of the white keys 20 that constitute one octave) is set to a value smaller than that of a standard keyboard instrument (in the embodiment, 154 mm that is reduced to about 15/16). Accordingly, it is also possible for a musical performer having relatively small hands to simultaneously press the white keys 20 having a relationship of one octave there between above or below with one hand only.

Figure 2:
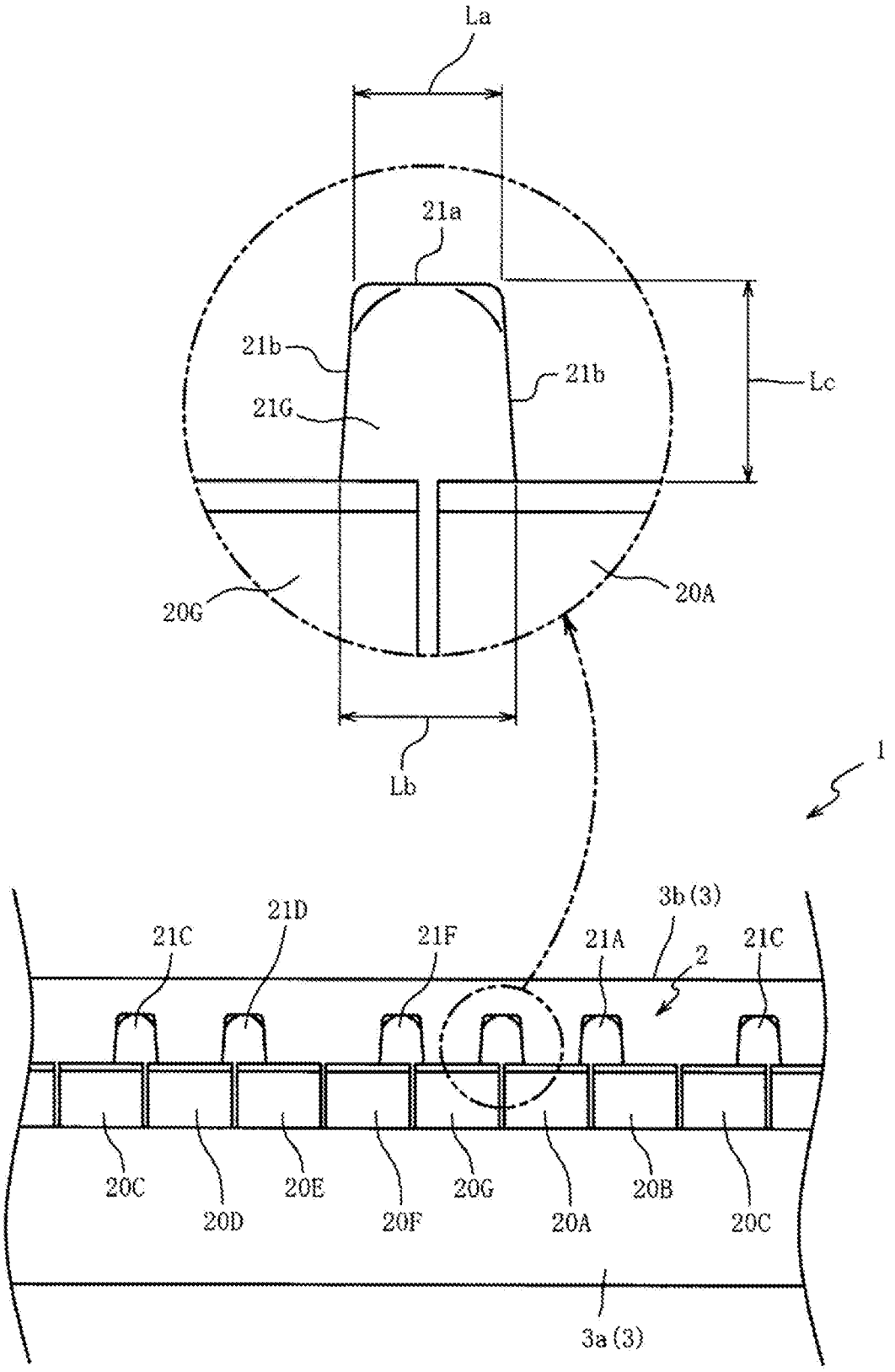
FIG. 2 is a partially enlarged front view of the keyboard instrument when seen in an arrow II direction in FIG. 1.

Next, a detailed configuration of the keyboard instrument 1 will be described with reference to FIG. 2. FIG. 2 is a partially enlarged front view of the keyboard instrument 1 when seen in an arrow II direction of FIG. 1.

As shown in FIG. 2, since the plurality of black keys 21 have substantially the same configuration (shape), only one black key 21 (the black key 21G) will be described, and description of the other black keys 21 will be omitted. The black key 21 includes an upper surface 21*a* configured as a key pressing surface, and a pair of side surfaces 21*b* hanging down from the upper surface 21*a* toward the white keys 20, which are formed of a resin material in an isosceles trapezoidal cross section.

Here, when seen in a front view of the black keys 21 (in the longitudinal direction), an intersection at which a straight line along the upper surface 21*a* of the black key 21 crosses an extension line of one of the side surfaces 21*b* is referred to as a first intersection, an intersection at which a straight line along the upper surface 21*a* of the black key 21 crosses an extension line of the other side surface 21*b* is referred to as a second intersection, and a length of a line segment that connects the first intersection and the second intersection is defined as a width dimension La of the upper surface 21*a* of the black key 21.

In the embodiment, the width dimension La of the upper surface 21*a* of the black key 21 is set to the same dimension (in the embodiment, 9.8 mm) as that of the standard keyboard instrument. Accordingly, operability (easiness of key pressing) when the black key 21 is pressed may be the same as that of the standard keyboard instrument. Accordingly, even when the keyboard instrument 1 is formed to be smaller than the standard keyboard instrument, operability of the black keys 21 can be improved.

In order to improve operability of the black keys 21, while the width dimension La of the upper surface 21*a* of the black key 21 is preferably made as large as possible, when the width dimension La is larger than a width dimension of the upper surface of the black key of the standard keyboard instrument, an operation feeling like the standard keyboard instrument cannot be easily obtained. Accordingly, the width dimension La of the upper surface 21*a* of the black key 21 is preferably set to 9.0 mm or more and 10.5 mm or less (i.e., the same value as that of the standard keyboard instrument). Accordingly, an operation feeling like the standard keyboard instrument can be obtained.

Here, when a width dimension (11.0 mm to 12.5 mm) of a bottom of the black key of the standard keyboard instrument is reduced to about 15/16, while the width dimension becomes 10.3 mm to 11.7 mm, a width dimension Lb of the bottom of the black key 21 is set to be less than 11 mm (in the embodiment, 10.7 mm).

Accordingly, since a space between the bottoms of the neighboring black keys 21 can be widened (a shape of the black key 21 approaches a rectangular cross-sectional shape), when a musical performer presses the white keys 20 (the white keys 20D, 20G and 20A) disposed between the black keys 21, interference of the black keys 21 with a musical performer's fingers can be minimized. Accordingly, even when the keyboard instrument 1 is formed to be smaller than the standard keyboard instrument, operability of the white keys 20 can be improved.

While the width dimension Lb of the bottom of the black key 21 is preferably set to be extremely small in order to improve operability of the white keys 20 disposed between the black keys 21, when the width dimension Lb is too small, it is difficult to secure the width dimension of the guide post inserted through the black keys 21 (or a width dimension of a wall section of the black key 21 that surrounds the guide post). Accordingly, the width dimension Lb of the bottom of the black key 21 is preferably set to 10.7 mm or more. Accordingly, the width dimension of the guide post inserted through the black key 21 (or the wall section of the black key 21 that surrounds the guide post) can be secured, and rigidity of the guide post (the black keys 21) can be secured.

In this way, in order to secure operability of both of the black keys 21 and the white keys 20 (the white keys 20D, 20G and 20A) disposed between the black keys 21, the width dimension Lb of the bottom of the black key 21 preferably approaches the width dimension La of the upper surface 21*a* of the black key 21. That is, although operability of the white keys 20 and the black keys 21 is improved when a shape of the black keys 21 approaches a rectangular shape when seen in a front view (an inclined angle of the side surface 21*b* with respect to the upward/downward direction is reduced), it becomes difficult to secure a draft angle during mold forming when the black keys 21 approach a rectangular shape, and mold release properties of the black keys 21 during such molding are deteriorated.

On the other hand, in the embodiment, since the width dimension Lb of the bottom of the black keys 21 is set to a value larger than that of the width dimension La of the upper surface 21*a* of the black keys 21, the side surfaces 21*b* of the black keys 21 are inclined, and a draft angle during mold forming can be secured. Accordingly, mold release properties during mold forming of the black keys 21 can be secured while improving operability of the white keys 20 and the black keys 21.

In this way, while the width dimension La of the upper surface 21*a* of the black key 21 is preferably set to a range of 9.0 mm or more and 10.5 mm or less and the width dimension Lb of the bottom of the black key 21 is set to a range of 10.7 mm or more and less than 11.0 mm, when a height dimension of the black key 21 (a dimension from the upper surface of the white key 20 to the upper surface 21*a* of the black key 21, in the embodiment, 12 mm) is set as Lc, the black key 21 is more preferably formed in an isosceles trapezoidal shape that satisfies a relation of $La<Lb$ and $2\ \text{degrees} \leq \arctan((Lb-La)/(2\times Lc))$. Accordingly, since the inclined angle of the side surface 21*b* of the black key 21 can be set to 2 degrees or more, a draft angle of the black keys 21 can be secured, and mold release properties during mold forming of the black keys 21 can be further improved.

In addition, since a embossing (a fine concavo-convex shape) is formed on the upper surface 21*a* of the black key 21 (see an enlarged portion of FIG. 1), a frictional resistance can be provided when a musical performer presses the upper surface 21*a* of the black keys 21. Accordingly, since a musical performer's finger can be prevented from slipping on the upper surface 21*a* of the black key 21 when the black key 21 is pressed, operability of the black keys 21 can be improved.

In addition, while the embossing is formed on the upper surface 21*a* of the black key 21, the side surfaces 21*b* of the black key 21 are formed as mirror planes. That is, the surface roughness Rz (in the embodiment, 5 μm or less) of the side surface 21*b* of the black key 21 is set to be smaller than a surface roughness Rz (in the embodiment, 10 μm or more) of the upper surface 21*a* of the black key 21. Accordingly, when a musical performer presses the white key 20 between the black keys 21, since a finger is likely to slip on the side surfaces 21*b* of the black key 21, operability of the white keys 20 (the white keys 20D, 20G and 20A) disposed between the black keys 21 can be improved.

In addition, the mirror planes of the side surfaces 21*b* of the black keys 21 are formed through specular working of inner surfaces (surfaces facing the side surfaces 21*b*) of a mold during mold forming, when the black key 21 is released from a mold, the inner surfaces of the mold easily slip on the side surfaces 21*b* of the black keys 21. Accordingly, even when the width dimension Lb of the bottom of the black key 21 is less than 11 mm and approaches the width dimension La of the upper surface 21*a* of the black key 21 (even when a cross-sectional shape of the black key 21 approaches a rectangular shape), mold release properties of the black keys 21 during mold forming can be improved.

Further, as described above, while an inclined angle of each of the side surfaces 21*b* of the black key 21 is preferably 2 degrees or more, this is because the side surfaces 21*b* of the black keys 21 can be formed as mirror planes. That is, when the side surfaces 21*b* of the black keys 21 are not mirror planes (for example, when emboss processing is performed on the side surfaces 21*b*), in order to secure mold release properties during mold forming, an inclined angle of each of the side surfaces 21*b* needs to be set to about 3 degrees (a draft angle is increased).

On the other hand, in the embodiment, since the side surfaces 21*b* of the black keys 21 are formed as mirror planes, even when the inclined angle of each of the side surfaces 21*b* of the black keys 21 is about 2 degrees, mold release properties during mold forming can be secured. In other words, since the inclined angle of each of the side surfaces 21*b* of the black keys 21 can be set to less than 3 degrees, the width dimension La of the upper surface 21*a* of the black key 21 can be increased to that extent or a space between the bottoms of the black keys 21 can be increased. Accordingly, operability of the black keys 21 and the white keys 20 (the white keys 20D, 20G and 20A) disposed between the black keys 21 can be improved.

Hereinabove, while the disclosure has been described on the basis of the embodiment, it is easy to infer that the disclosure is not limited to the embodiment and various modifications may be made without departing from the spirit of the disclosure.

While the case in which the keyboard instrument 1 is configured as an electronic musical instrument (an electronic piano) has been described in the embodiment, there is no limitation thereto. For example, the technical spirit of the embodiment can also be applied to another small musical instrument (a piano, an organ, or the like) or a small electronic musical instrument (an electronic organ or the like) in which a width dimension of a key is reduced from the standard keyboard instrument.

While the case in which a total width dimension of the white keys 20 that constitute one octave is set to a dimension (154 mm) reduced to about 15/16 from the standard keyboard instrument has been described in the embodiment, there is no limitation thereto. For example, when the total width dimension of the white keys 20 that constitute one octave is 128 mm or more of the keyboard instrument, the technical spirit of the embodiment can be applied.

While the case in which the white keys 20 and the black keys 21 are formed of a resin material has been described in the embodiment, there is no limitation thereto. For example, of course, it is possible to form the white keys 20 and the black keys 21 using another material (for example, wood).

While the case in which the plurality of black keys 21 have substantially the same configuration has been described in the embodiment, there is no limitation thereto. For example, shapes of the black keys 21 (the width dimension La of the upper surface 21*a*, the width dimension Lb of the bottom, existence of the embossing of the upper surface 21*a*, and existence of specular working on the side surfaces 21*b*) may be different from each other at the black keys 21. That is, the configuration of the black keys 21 of the embodiment need not be applied to all of the black keys 21 but may be applied to some of the black keys 21.

Accordingly, for example, when some of the side surfaces 21*b* of the black keys 21 are formed as mirror planes, specular working is preferably performed on the side surfaces 21*b* only disposed between facing surfaces of the black keys 21 having a small facing interval (between the neighboring black key 21C and 21D or between the neighboring black keys 21F, 21G and 21A). Accordingly, manufacturing costs of the black keys 21 can be reduced while securing operability of the white keys 20 (the white keys 20D, 20G and 20A) disposed between the black keys 21 having a small facing interval.

While the case in which the black key 21 is formed in an isosceles trapezoidal shape when seen in a front view has been described in the embodiment, there is no limitation thereto. For example, a configuration in which the black key 21 is formed in a rectangular shape when seen in a front view (an inclined angle of each of the pair of side surfaces 21*b* is 0 degree) or a configuration in which the black keys 21 are formed in another trapezoidal shape (inclined angles of the pair of side surfaces 21*b* are different from each other) may be provided.

That is, in the embodiment, when the width dimension La of the upper surface 21*a* of the black key 21 is set to 9.0 mm or more and 10.5 mm or less, while it has been described that the width dimension Lb of the bottom of the black key 21 is preferably in a range of 10.7 mm or more and less than 11 mm, there is no limitation thereto. For example, the width dimension Lb of the bottom may be a dimension of less than 10.7 mm or 11 mm or more, and may be at least a value of the width dimension La or more of the upper surface 21*a* of the black key 21.

While the case in which the embossing on the upper surface 21*a* of the black key 21 or the mirror planes on the side surfaces 21*b* are formed during mold forming has been described in the embodiment, there is no limitation thereto. For example, after the black keys 21 are formed through molding, the embossing or the mirror plane may be formed by performing blasting or mirror plane finishing on the upper surface 21*a* or the side surfaces 21*b* of the black key 21. In addition, emboss processing may be performed on the side surfaces 21*b* of the black keys 21, and mold release properties of the black keys 21 during mold forming can be improved while improving operability of the black keys 21 as long as the surface roughness Rz of the upper surface 21*a* is larger than that of at least the side surfaces 21*b* of the black keys 21. In addition, emboss processing on the upper surfaces 21*a* of the black keys 21 or specular working on the side surfaces 21*b* may be omitted.

Further, when emboss processing is performed on the side surfaces 21*b* of the black keys 21 (or specular working is not performed), the width dimension La of the upper surface 21*a* of the black key 21 may be set to 9.0 mm or more and 10.5 mm or less, the width dimension Lb of the bottom of the black key 21 may be set to 10.7 mm or more and less than 11.0 mm, and the black keys 21 may be formed in an isosceles trapezoidal shape that satisfies a relation of La<Lb and 3 degrees arctan ((Lb−La)/(2×Lc)). Accordingly, even when the side surfaces 21*b* of the black keys 21 are not mirror planes, mold release properties of the black keys 21 during mold forming can be secured.

While the case in which the embossing formed on the upper surface 21*a* of the black key 21 is a fine concavo-convex shape has been described in the embodiment, there is no limitation thereto. For example, the embossing having a shape with which a linear or curved groove is combined may be formed on the upper surface 21*a* of the black key 21.

While the case in which operability of the white keys 20 or the black keys 21 is improved by shapes of the black keys 21 (the width dimension La of the upper surface 21*a*, the width dimension Lb of the bottom, the embossing on the upper surface 21*a*, and the mirror planes on the side surfaces 21*b*) has been described in the embodiment, there is no limitation thereto. For example, the black keys 21 may be disposed at positions deviated from relative positions of the black keys with respect to the white keys of the standard keyboard instrument, and a facing interval between the black keys 21 may be widened. Accordingly, operability of the white keys 20 (the white keys 20D, 20G and 20A) disposed between the black keys 21 can be further improved.

In addition, when the black keys 21 are formed swingably in the widthwise direction and a musical performer's finger is inserted between the facing surfaces of the black keys 21, the black keys 21 may be configured to be spread out by the musical performer's finger. Accordingly, operability of the white keys 20 (the white keys 20D, 20G and 20A) disposed between the black keys 21 can be further improved.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A keyboard instrument in which a plurality of white keys and a plurality of black keys are arranged in a widthwise direction, wherein a total width dimension of the plurality of white keys that constitute one octave is set to 160 mm or less resulting in a narrowing of the white keys, and a width dimension of an upper surface of each of the black keys is set to 9 mm or more and 10.5 mm or less.

2. The keyboard instrument according to claim 1, wherein a width dimension of a bottom of each of the black keys is less than 11 mm.

3. The keyboard instrument according to claim 2, wherein the width dimension of the bottom of each of the black keys is 10.7 mm or more.

4. The keyboard instrument according to claim 2, wherein the width dimension of the bottom is set to be larger than the width dimension of the upper surface of each of the black keys.

5. The keyboard instrument according to claim 3, wherein the width dimension of the bottom is set to be larger than the width dimension of the upper surface of each of the black keys.

6. The keyboard instrument according to claim 4, wherein, provided that the width dimension of the upper surface of each of the black keys is La, the width dimension of the bottom of each of the black keys is Lb and a height dimension of each of the black keys is Lc, each of the black keys is formed in an isosceles trapezoidal shape that satisfies a relation of 2 degrees≤arctan ((Lb-La)/(2×Lc)).

7. The keyboard instrument according to claim 5, wherein, provided that the width dimension of the upper surface of each of the black keys is La, the width dimension of the bottom of each of the black keys is Lb and a height dimension of each of the black keys is Lc, each of the black keys is formed in an isosceles trapezoidal shape that satisfies a relation of 2 degrees≤arctan ((Lb-La)/(2×Lc)).

8. The keyboard instrument according to claim 6, wherein an inclined angle of a side surface of each of the black keys is set to 2 degrees or more and about 3 degrees.

9. The keyboard instrument according to claim 2, wherein a surface roughness of the upper surface is larger than a surface roughness of a side surface of each of the black keys.

10. The keyboard instrument according to claim 3, wherein a surface roughness of the upper surface is larger than a surface roughness of a side surface of each of the black keys.

11. The keyboard instrument according to claim 4, wherein a surface roughness of the upper surface is larger than a surface roughness of a side surface of each of the black keys.

12. The keyboard instrument according to claim 5, wherein a surface roughness of the upper surface is larger than a surface roughness of a side surface of each of the black keys.

13. The keyboard instrument according to claim 6, wherein a surface roughness of the upper surface is larger than a surface roughness of a side surface of each of the black keys.

14. The keyboard instrument according to claim 7, wherein a surface roughness of the upper surface is larger than a surface roughness of a side surface of each of the black keys.

15. The keyboard instrument according to claim 9, wherein the side surface of each of the black keys is formed as a mirror plane.

16. The keyboard instrument according to claim 9, wherein emboss processing is performed on the side surface of each of the black keys.

17. The keyboard instrument according to claim 9, wherein emboss processing is performed on the upper surface of each of the black keys.

18. The keyboard instrument according to claim 1, wherein the keyboard instrument is configured as a piano.

19. The keyboard instrument according to claim 1, wherein hammers linked to operations of the white keys and the black keys are provided.

20. The keyboard instrument according to claim 1, wherein the keyboard instrument is configured as an electronic keyboard instrument configured to generate a musical sound signal according to operations of the white keys and the black keys.

* * * * *